United States Patent [19]

Nedwick

[11] 4,257,607

[45] Mar. 24, 1981

[54] GOLF SWING GUIDES

[76] Inventor: Zygmund Nedwick, 32 Poplar Pl., Glen Cove, N.Y. 11542

[21] Appl. No.: 59,974

[22] Filed: Jul. 23, 1979

[51] Int. Cl.[3] ..... A63B 69/36

[52] U.S. Cl. ..... 273/183 B; 273/DIG. 30; 273/186 C; 273/189 A

[58] Field of Search ..... 46/DIG. 1; 128/DIG. 15; 273/DIG. 30, 183 B, 54 B, 186 C, 191 R, 192, 188 R, 189 A, 189 R

[56] References Cited

U.S. PATENT DOCUMENTS

| | | | |
|---|---|---|---|
| 3,436,075 | 4/1969 | Robinson | 273/54 BA X |
| 3,895,797 | 7/1975 | Moore | 273/DIG. 30 |

FOREIGN PATENT DOCUMENTS

| | | | |
|---|---|---|---|
| 201666 | 8/1923 | United Kingdom | 273/183 B |

*Primary Examiner*—George J. Marlo

*Attorney, Agent, or Firm*—Richard L. Miller

[57] ABSTRACT

A golf swing guide that serves as an aid for a correct golf playing stroke, the device including a base member adhered to a golf player's glove or mid-riff site, and an indicator member detachably attached by Velcro fasteners to the base member, the indicator member including an upstanding, flat arrowhead including pointed side spurs of unequal lengths, a point and a plane of which are utilized directionally for accomplishing the correct stroke.

1 Claim, 11 Drawing Figures

10
29
31
30

GOLF SWING GUIDES

BACKGROUND OF THE INVENTION

This invention relates generally to golf playing aids.

Golf players strive to develop the skills that will enable them to strike the ball consistantly along a predetermined line of direction on a trajectory that satisfies the degree of loft in the club face.

The golf instructors who achieve success teaching the art of striking the golf ball effectively are agreed in the main on the basic fundamentals and principles that apply to the functions of golf swing arcs that produce such desirable results.

Golfers will vary in physical dimensions and in temperament and their swing arcs and rhythm patterns also can vary but results may be similarly effective. Swing arcs can be wide-arced, particularly graceful and fluid while some others are abbreviated, compact and quick, but in each case where the results are similarly effective the golfer will be following and applying the same set of basic fundamentals and principles.

Basically, upon setting the club face squarely to the target on the address to the ball, golf instructors are universally agreed that the hands grip the club with the palms facing each other, with the right palm of the right handed player looking down the target line. Thus the club face, the right palm and the back of the left hand are all coincidental in their relationship to the target proper. The professional instructors state too that both hands act in unison; and that the club handle should be gripped primarily with the fingers, and held somewhat diagonally across the palms as the club shaft slopes to the ball. It is essential too they state, that the feet, knees, hips and shoulders be aligned parallel and set squarely to the target line of direction, with the trunk fairly erect. The line of direction is an imaginary line visualized to extend from the target through the ball to continue some distance laterally from the player. The line of direction is an important guide as a control for the direction of travel for the backward and forward swing arcs. Also they refer to that angle of incidence that extends, as a hypotenuse, from the line of direction to the top of the player's shoulder. This angle of slope acts as a guide to set the angular plane for the golfer's swing arc which needs to travel backward and forward, so properly tilted, and following the target line of direction. (see Ben Hogan's 5 Lessons). Reference are made to the coiling up process of the large upper and lower body muscles and their sequential order of doing so around the spine as the vertical axis that creates a torsion force which expends itself explosively when the forward swing arc propels the club head through the ball. (see Carl Lohren's, The One Move To Better Golf).

Thus there are fundamental requirements of physical alignments and swing functions to planar and angular relationships with the target and the line of direction.

Such relationships of the swing arcs to guide lines are difficult to note with certainty by the player or to be conveyed accuately to the player by an attending instructor since the golf swing is essentially very fast. To visualize guide lines and to estimate positional relationships of the golf swing to guide lines while the swing is in progress is often a blurred impression. Swing refinements can be made obvious to the TV viewer when it is stop-fragmented by the camera, but that is not practicable during the game or on a practice tee.

SUMMARY OF THE INVENTION

Accordingly, it is a principal object of the present invention to provide a Golf Swing-Scope which is Velcro-attached to a golf player's gloved hand, or hands, and at a belt buckle site, so as to produce a set of references to positional aspects as the swing is performed.

Another object is to provide a Golf Swing-Scope which acts as a check of swing fundamentals.

Still another object is to provide a Golf Swing-Scope which gives insight to, and restraints to golf swing functions.

Still a further object is to provide a Golf Swing-Scope which gives to the peripheral vision of the golf player and to an attending instructor, a set of references, other than the golf club itself, to positional aspects of the hands to guide lines, and how the hands combine with the golf club to relate to the target, to the ball, and the line of direction to the target.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DISCRIPTION OF THE DRAWING FIGURES

The Figures on the drawings are briefly described as follows.

DETAILED DESCRIPTION OF PREFERRED EMBODIMENT

Figure 1:
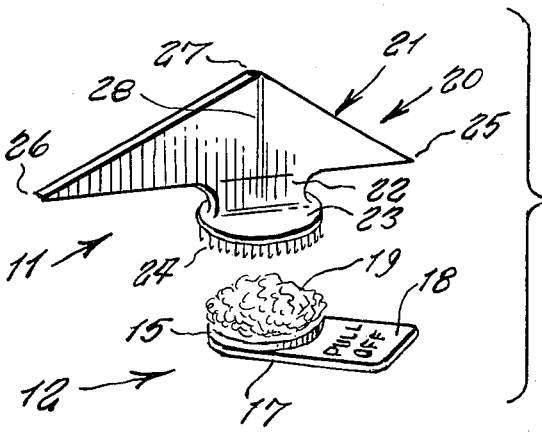
FIG. 1 is a perspective view of the invention prior to attachment upon its mounting base.

Referring now to the drawings in greater detail, and more particularly to FIGS. 1 through 6 thereof at this time, the reference numeral 10 represents a Golf Swing-Scope according to the present invention wherein the same is shown to be comprised of an indicator unit 11 and a base unit 12 upon which the indicator unit is attachable, and the base unit is mountable upon a back-hand side of either a left hand glove 13 or right hand glove 14 of a golf player.

Figure 2:
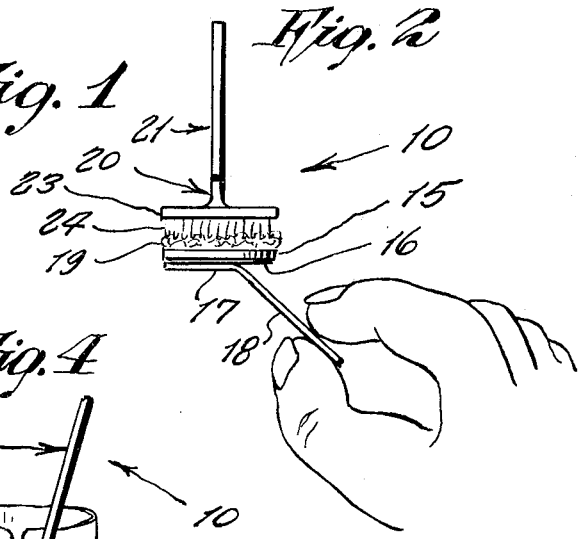
FIG. 2 is a side view thereof assembled on its base, and showing the protective paper being peeled off so as to expose the adhesive for attachment upon a glove or other object.

The base unit is comprised of a circular, flat disc 15 made preferably of a light-weight material such as plastic. A pressure sensitive adhesive 16 is applied to one side of the disc, and the adhesive is then covered by a sheet of paper 17, for protecting the adhesive prior to use of the device, and which can be readily peeled off therefrom when the adhesive is desired to be exposed for attachment to a glove. The paper sheet accordingly is cut a same size and shape as the disc and additionally includes a tab portion 18 integral therewith so that it can be readily grasped by hand and pulled so as to peel the entire paper from the adhesive, as shown in FIG. 2 of the drawing. An opposite side of the disc has a cotton-like, Velcro component 19 glued thereto for detachable attachment to the indicator unit 11.

The indicator unit includes a member 20 made of a light weight material such as plastic which can be easily molded into the particular shape thereof. The member 20 comprises a flat arrowhead 21 with stem 22 at right angle to a circular disc 23. The arrowhead is formed across a center of one side of the disc; the opposite side of the disc having a Velcro component 24 affixed thereto consisting of bristles which are hook shaped on their outward ends for grasping the Velcro component 19 of the base unit. The disc 23 is the same size as the disc 15.

The arrowhead 21, standing perpendicular to the disc 23 is triangular in shape by including spurs 25 and 26 at each side and a tapered point 27. One of the spurs 25 extends sidewardly a shorter distance than spur 26. The point 27 is directly over a center of the disc and a line 28 is grooved on both flat sides of the arrowhead, the lines extending from the tip to the disc center, so that the lines are perpendicular to the plane of the disc 23.

A Swing-Scope will duplicate in miniature on the back of a gloved hand the principle of the golf shaft 29 and its perpendicular off-shoot, the club head 30. A long line indicator set diagonally across the back of a gloved hand will slant to correspond with the slant of the golf shaft when held and set behind the golf ball 31 in the golfer's stance at address. A perpendicular feature or indicator protruding from a central location would, on the set-up to the ball, parallel the set of the golf club face. Thus on the addressing of the ball and at impact the miniature representation of the golf club features on the back of the gloved hand would correspond identically to the position of the golf shaft and club face at those two moments. If two gloves are worn normally, or to augment the visual factor during the training period, the replica on the away hand will be a mirror image of the replica on the lead hand.

Figure 3:
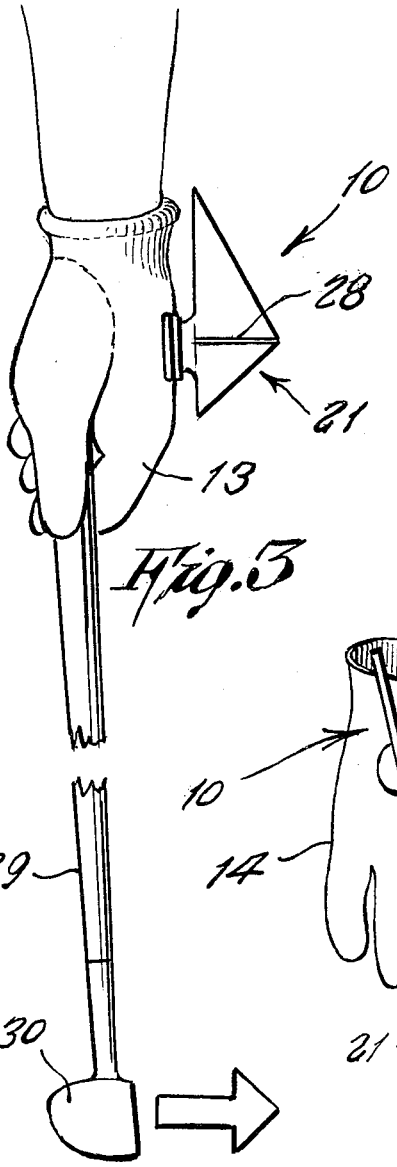
FIG. 3 shows the device assembled and mounted upon a left hand glove, shown in a side view.
Figure 4:
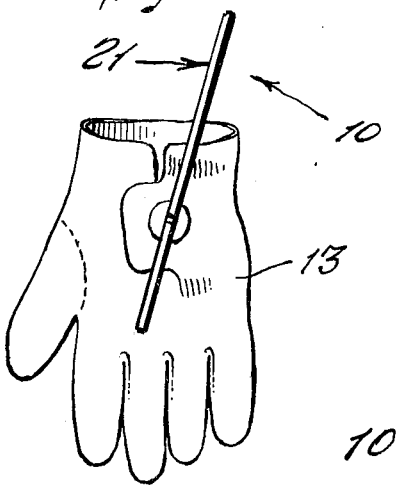
FIG. 4 is a top view of the device mounted upon a left hand glove, shown in a back hand view.
Figure 5:
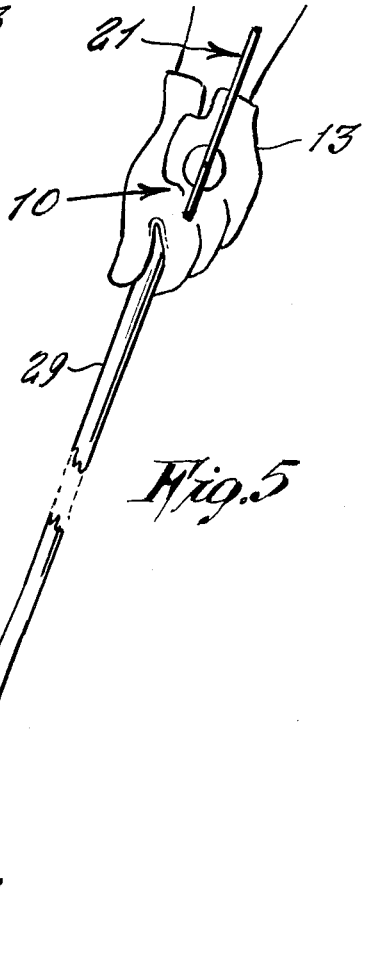
FIG. 5 shows the glove of FIG. 4 being worn and in use on a left hand.
Figure 6:
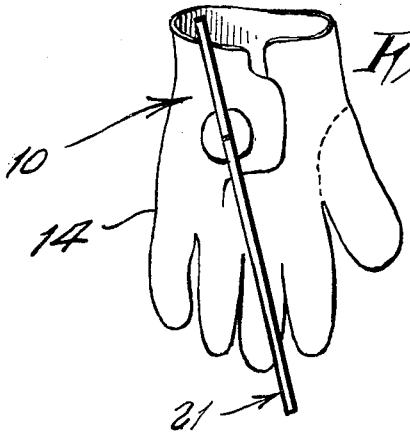
FIG. 6 is a view similar to FIG. 4 showing the device mounted on a right hand glove.
Figure 7:
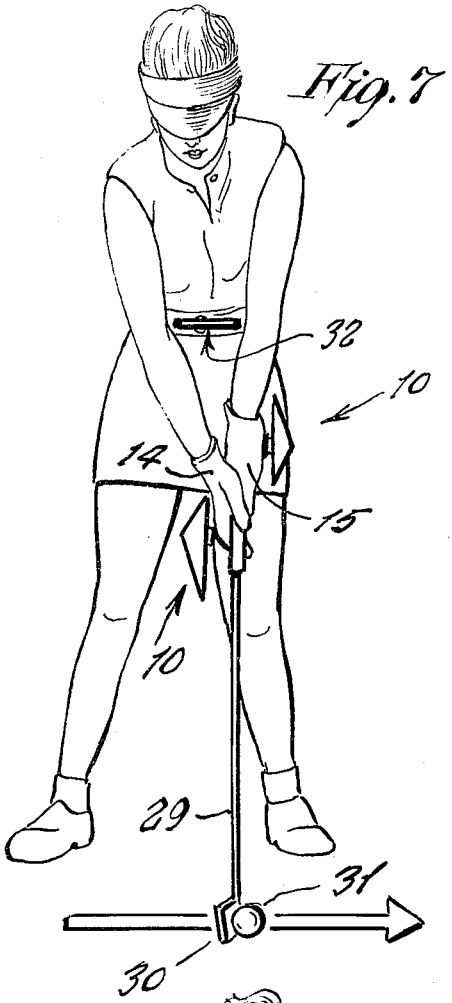
FIGS. 7 through 11 show various poses of players ready to drive a golf ball, and shown wearing the invention.
Figure 8:
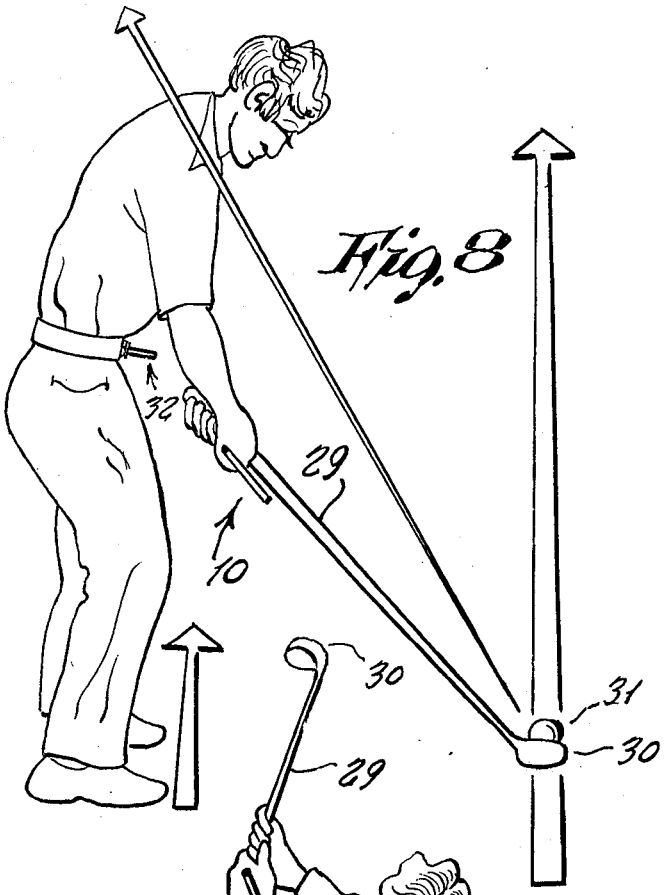
Figure 9:
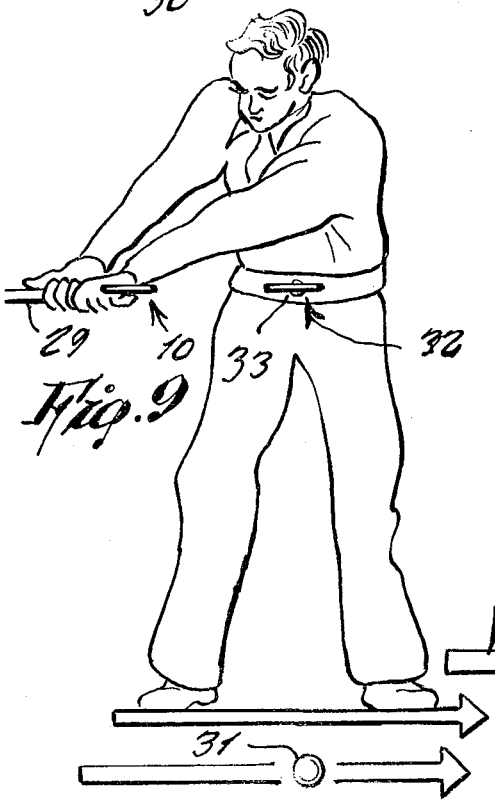
Figure 10:
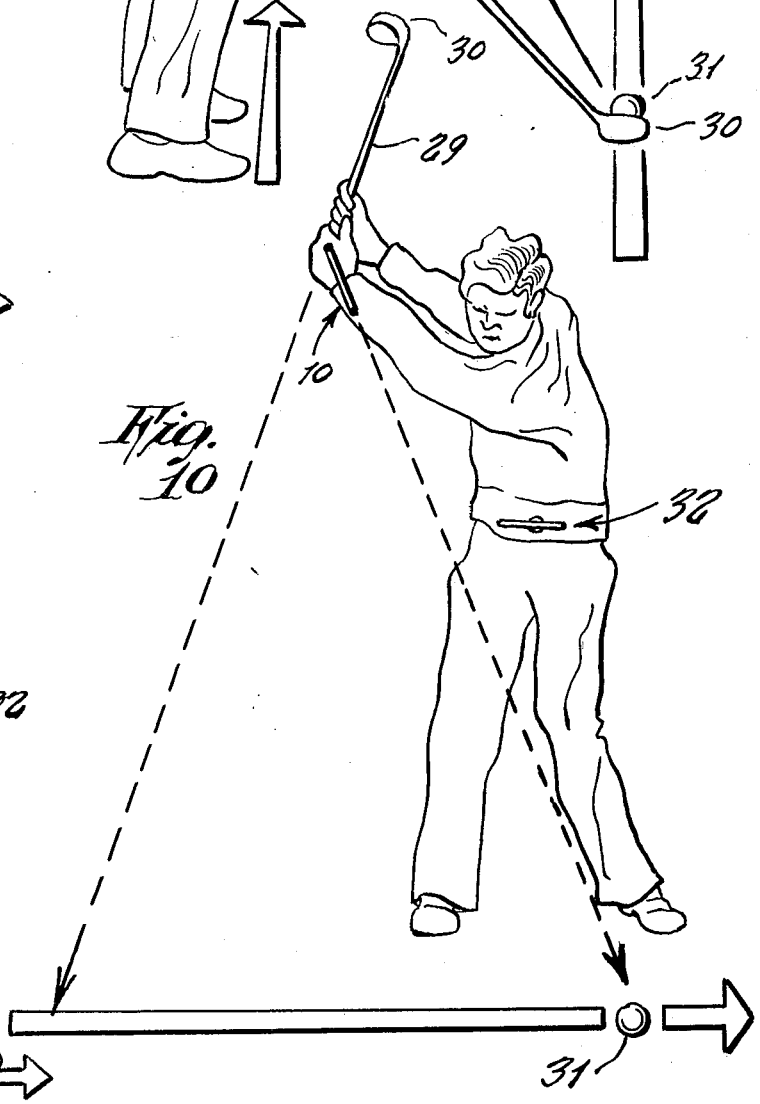
Figure 11:
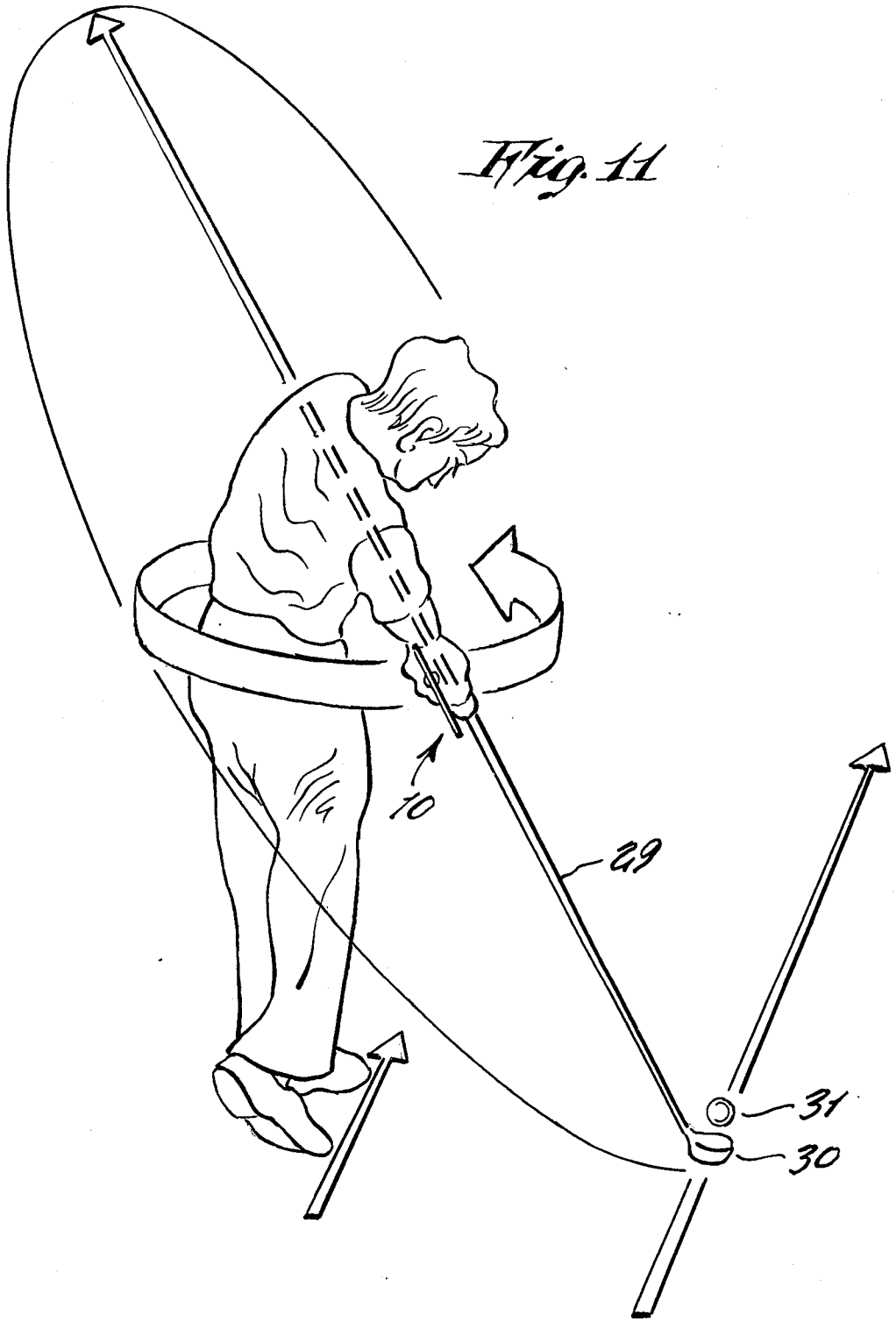

The purpose for having the spur 26 extend a greater distance sidewardly than the opposite spur 25 is best shown in FIG. 3 of the drawing, wherein the long spur 26 is shown providing a bridge that spans across the wrist joint and forms a longer extension from the back of the gloved hand to alongside the forearm for an increased directional accuracy when viewing the arrowhead. The longer spur also serves to notify the player if his wrist is flexed too much so that the gloved hand is moved and bent excessively toward the forearm, whereby the spur 26 touching the forearm causes the indicator unit to be dislodged from the base unit.

A Golf Swing-Scope 32 similar in design to Golf Swing-Scope 10 would be used at the mid-riff site 33 also but would have a different function. The long line indicator will be set to parallel the line of direction. The perpendicular feature therefore would extend toward the line of direction to indicate a degree of levelness of the hips. The Swing-Scope at the belt buckle site provides an insight to general alignment and posture at the set-up to the ball. A knees flexed, sitting back with the back fairly straight, and a head up posture at the address to the ball would cause the perpendicular feature, protruding toward the direction line, to indicate a more horizontal plane than would a stiff legged, chin on chest, slumped over at the waist posture, for example.

Also the Scope at the belt buckle site will pose a possible hindrance to the back swing arc at the take-away from the ball. In fact following a path to avoid the Swing-Scope at the belt buckle site will cause the movement of the club head on the back swing arc to travel directly along the direction line, as against spinning the arms closely to the body to follow the turning of the shoulders. Brushing or dislodging the Swing-Scope at the belt buckle site on the back swing would be a mechanical indication that the back swing arc is moving inside the target line.

On the forward swing arc, if the right elbow of a right handed golfer were to brush or dislodge the training device at the belt buckle site it would indicate the lack of sufficient forward hip turn and thrust toward the target proper: to clear a path and to establish a direction prior to the descent of energy from the return of the upper body.

Again, in the typical golf situation it is uniformly accepted by acknowledged instructors that the club face should be set squarely to the target proper and that the palms, facing each other, must coincide with the club face postion. Also, since the club shaft must, of necessity, slope diagonally away from the player to set behind the ball, then the handle, grasped by the forefingers, will be held more or less diagonally across the palms also. Thus the objective in the design of the Swing-Scope is to approximate the address and impact position of the golf club features i.e. the golf shaft slanting toward the ball and its perpendicular off-shoot the club head looking down the target line. Therefore the Swing-Scope on a gloved hand employs two features or line indicators, one to mimic the slant of the golf slant and a vertical or perpendicular feature to parallel the club head. Thus a reference to the golf club is reproduced in miniature on the back of a gloved hand to coincide with the golf club features and will relate to the golf club, to the line of direction and the target proper.

The golf club is an integral device and is so represented on the back of the player's gloved hands. When the wrists must hinge or cock toward the thumbs, prior to imparting added force at impact, the Swing-Scope cannot hinge in a corresponding manner. During this phase of the golf swing the Swing-Scope refers to the posture of the hands in regard to the aforementioned guide lines. The angular aspects of the golf shaft and club face are compared to the line of direction, as done so traditionally, and are also coupled with the indicative features of the Swing-Scope as a readable unit to provide significant relationships to each other, to the ball, and the target line during this phase of the golf swing.

Thus visual reference that can relate swing actions to envisioned guide lines can provide insights to the eye of an attending instructor and to the peripheral vision of the player who will screen and categorize impulses for his muscle memory bank. The instructor also might wear the visual aids to demonstrate and compare positional aspects of the golf swing with the student golfer, as defined by clearly etched features on the golf Swing-Scope, when otherwise the subtleties of hand positions might escape the discernment of the student golfer.

Also the diagonal feature on the back of the golfer's lead hand only, that coincides with the slope or slant of the golf shaft at the address to the ball, has an added mechanical function: to promote firmness, and straightness at the wrist joint with the forearm, promoting singleness or unity in the action of the hands. Thus the diagonal feature here needs to be extended to cross the wrist joint and to position slightly inside and beyond the wristbone. It will simulate the straightness and unbroken relationship of the forearm to the back of the left hand, for example, of the right handed golfer. This firmness and straightness at the wrist joint is advocated by the professional instructor: to maintain a square alignment of the club face to the target proper, and to insure the transfer of energy to the club head that flows from the tip of the shoulder as the fulcrum, to the club head representing the end of a lever. If the wrist joint were to hinge forwardly, it would direct the club face to aim inside the target line. Also such pronating action of the hands would dissipate the flow of energy as described, and force the extended portion of the diagonal indicator to press against the wrist bone. It would be felt by the player and the Swing-Scope might be loosened or dislodged. It would indicate the reason for an ineffectual shot. Both hands working in unison to maintain a firmness at the wrist joint and a straightness between the forearm and the back of the lead hand will keep the extended portion of the longer diagonal feature off the wrist bone and indicates that the lead forearm is in a desirable, gradual supinating rotation, causing the lead hand to turn from a palm down to a palm up position. (see Ben Hogan's 5 Lessons).

Very importantly too, the unit at the belt buckle site would function to compare the degree of hip turn on the back swing to the degree of hip turn and thrust forwardly. It will indicate the sequential order in the coil-up procedure of the energy producing torque of the large lower and upper body muscles and the subsequent release of torsion force. Delaying and limiting the backward turning of the hips, by bracing the away leg toward the target keeping the weight over the inside of the foot, as the shoulders make a maximum turn, will create a torsion force that will be further maximized when, aided by the forward thrust of the legs, the hips turn toward the target while the upper body muscles are held back, to be delayed momentarily as the torque is heightened. The slight delay is necessary for directional efficiency: to allow the hips and the perpendicular feature of the Swing-Scope to aim directly at the target proper, and so set the direction for the release of energy in the stretched muscles of the upper back, shoulder, and upper arm of the leading side. (see Carl Lohren's The One Move To Better Golf). As pointed out in a paragraph above, lack of sufficient hip turn and a prior thrust of the hips toward the target, coupled with insufficient delay in the return or descent of the upper body may cause the elbows to brush, loosen or dislodge the Swing-Scope at the belt buckle site, indicating a lack of fundamental procedure in the golf swing.

Therefore the above-described golf Swing-Scopes will provide mechanical restraints and checks on improper fundamental actions and will act as a source of visual references during the progress of the golf swing as the Swing-Scope features are compared positionally to the target line, to the golf club, and target proper.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A golf swing guide, comprising in combination, a base member and an indicator member detachably attachable together, and said base member including means for mounting upon either a glove or upon a midriff site of a golf player; said means having the characteristic of permitting directional adjustability between said members, said indicator member including an arrowhead of triangular shape with a pointed spur at each side and an outwardly extending point to which said spurs are tapered, and one said spur being longer than the other.

* * * * *